US006303078B1

(12) United States Patent
Shimizu et al.

(10) Patent No.: US 6,303,078 B1
(45) Date of Patent: Oct. 16, 2001

(54) ANTIFOULING STRUCTURE HAVING EFFECT OF PREVENTING ATTACHMENT OF AQUATIC ORGANISMS THERETO

(75) Inventors: Takao Shimizu; Masahiko Nanjyo, both of Okayama-ken; Shingo Nakanishi, Osaka, all of (JP)

(73) Assignees: Kuraray Co., Ltd., Kurashiki-shi; Kuraray Trading Co., Ltd., Osaka-shi, both of (JP)

( * ) Notice: Subject to any disclaimer, the term of this patent is extended or adjusted under 35 U.S.C. 154(b) by 0 days.

(21) Appl. No.: 09/389,049

(22) Filed: Sep. 2, 1999

(30) Foreign Application Priority Data

Sep. 9, 1998 (JP) ..... 10-254475
Sep. 9, 1998 (JP) ..... 10-254476

(51) Int. Cl.[7] ..... C23F 11/00
(52) U.S. Cl. ..... 422/8; 422/6; 422/14; 428/35.1
(58) Field of Search ..... 422/6, 8, 14; 428/35.1

(56) References Cited

U.S. PATENT DOCUMENTS

| | | | | |
|---|---|---|---|---|
| 4,167,597 | | 9/1979 | Yoshida et al. . | |
| 4,375,540 | * | 3/1983 | Joyner et al. | 528/302 |
| 4,450,250 | * | 5/1984 | McConnell et al. | 524/141 |
| 4,576,997 | * | 3/1986 | Trotter et al. | 525/444 |
| 5,153,066 | * | 10/1992 | Tanaka et al. | 428/373 |
| 5,354,603 | * | 10/1994 | Errede et al. | 428/240 |
| 5,409,804 | * | 4/1995 | Inaba et al. | 430/393 |

OTHER PUBLICATIONS

Patent Abstracts of Japan, vol. 1996, No. 12, Dec. 26, 1996, JP 08–214730, Aug. 27, 1996.
Patent Abstracts of Japan, vol. 016, No. 425 (C–0982), Sep. 07, 1992, JP 04–146269, May 20, 1992.
Patent Abstracts of Japan, vol. 1998, No. 14, Dec. 31, 1998, JP 10–259258, Sep. 29, 1998.
Patent Abstracts of Japan, vol. 1999, No. 03, Mar. 31, 1999, JP 10–337132, Dec. 22, 1998.
Patent Abstracts of Japan, vol. 1999, No. 04, Apr. 30, 1999, JP 11–012477, Jan. 19, 1999.

* cited by examiner

*Primary Examiner*—Robert J. Warden, Sr.
*Assistant Examiner*—Imad Soubra
(74) *Attorney, Agent, or Firm*—Oblon, Spivak, McClelland, Maier & Neustadt, P.C.

(57) ABSTRACT

A structure comprises, as the major component, a molded member of a thermoplastic resin composition or a fibrous material which may be a fiber of the thermoplastic resin composition, a yarn coated with the thermoplastic resin composition, a rope coated with the thermoplastic resin composition or a woven fabric coated with the thermoplastic resin composition. The thermoplastic resin composition contains an antifouling compound represented by the following formula (1):

(1)

wherein Y represents hydrogen atom, an alkyl group, an alkenyl group or an aralkyl group, R represents hydrogen atom, a halogen atom or an alkyl group, R' represents hydrogen atom, a halogen atom or an alkyl group and R and R' may be bonded to each other to form a benzene ring. The leaching amount of the antifouling compound into an artificial sea water is controlled to 30 mg/cm$^3$ or less at 25° C. and 3 mg/cm$^3$ or more at 15° C. per a unit volume of the thermoplastic resin composition when integrated during initial 10 days after immersing the structure into the artificial sea water, thereby preventing the attachment of aquatic organisms for a long time. Also, the structure may be made water-permeable to have a water permeability of 1 cm$^3$/cm$^2$·sec or more under a pressure of 18 cm water, thereby broaden the application field thereof.

29 Claims, 1 Drawing Sheet

ANTIFOULING STRUCTURE HAVING EFFECT OF PREVENTING ATTACHMENT OF AQUATIC ORGANISMS THERETO

BACKGROUND OF THE INVENTION

1. Field of the Invention

The present invention relates to a structure for use in contact with sea water or fresh water for a long time, and more particularly, to a structure capable of effectively preventing aquatic organisms for a long time from attaching thereto or an object covered therewith. The present invention also relates to a water-permeable structure for preventing the attachment of aquatic organisms to, for example, a sensor for use in water analysis, thereby ensuring prolonged optimum conditions for obtaining accurate water analysis. The present invention also relates to a filter excellent in preventing the attachment of aquatic organisms and allowing a long-term stable permeation of sea water or fresh water therethrough, and further relates to a cover for a bottom or a screw of ship easily attachable to or detachable from the bottom or the screw due to its good water permeability.

2. Description of the Related Arts

Examples of products for use under sea water or in partial contact with sea water for a long time include fishery equipment such as a fixed net for fishing and a fish preserve net for cultivating fish and shellfish, nautical equipment such as a floating nautical mark, a floating buoy and a mooring buoy, and civil engineering equipment such as a membrane and a fence for preventing water pollution. When these equipments are kept in contact with sea water for a long time, adhesive marine organisms attach to the surface thereof, and live and propagate there. Examples of such adhesive marine organisms include algae such as sea lettuce (ulva) and diatom, coelentera such as sea anemone (actinia), sponge such as beach sponge, annelids such as clam worm (nereid), tentaculatae such as sea moss (bryozoan), mollusk such as moule (Hiatula diphos), arthropod such as barnacle, and protochordate such as sea squirt (ascidian). The attachment of marine organisms to the above equipments causes a problem of preventing the equipment from exhibiting the expected function sufficiently.

Recently, studies has been made on the technique in which the properties of river water and sea water are continuously monitored by measuring various items such as dissolved oxygen content, pH, temperature, salt content, ammonia content and turbidity, and the obtained data are analyzed to predict red tide, rapid environmental change and occurrence of natural hazard so as to use the results in cultivating fish and preventing natural hazards. Sensors and systems to obtain automatically these data have been developed and are under examination for practical use.

However, when a sensor is continuously kept in water to obtain water data, aquatic organisms such as those described above are attached to the detector of the sensor. As a result thereof, within a period as short as a few days, the sensor becomes out of order to give abnormal data and the accurate measurement becomes impossible. Therefore, it is necessary that the aquatic organisms be frequently removed or the sensor be repaired or replaced with new one. Since the monitoring system is frequently placed far from the shore, the repair or the replacement is labor-intensive, thereby retarding the wide application of the automatic monitoring system.

To prevent aquatic organisms from attaching to a structure kept in contact with sea water for a long time, the following method has been employed heretofore.

The conventional method generally employed is to treat a structure with an organotin compound such as tributyltin oxide, triphenyltin hydroxide, triphenyltin acetate and triphenyltin chloride. However, the organotin compound generates awfully unpleasant or irritating smell during the treating operation. Moreover, it has recently become clear that the organotin compound is accumulated in fish body to cause deformation and death of fish, and that eating the contaminated fish is detrimental to the human health. Therefore, the use of the organotin compound is voluntarily restricted in the fishery field and may be completely prohibited before long.

Therefore, it is desired to develop a new method as a substitute for the method using the organotin compound having the above severe drawbacks.

In one of such new methods, the equipment is treated with an organic sulfur-nitrogen compound such as urea compound, benzimidazole compound, benzothiazole compound, thiophthalimide compound and sulfonylpyridine compound. This method is an attempt to apply the organic sulfur-nitrogen compound to preventing the attachment of aquatic organisms based on the fact that the organic sulfur-nitrogen compound has been widely used as an agricultural chemical, a bactericide and a fungicide. It has been known that the organic sulfur-nitrogen compound is less toxic to human body and fish, and decomposes into a non-toxic compound after accomplishing its function of preventing the attachment of aquatic organisms.

As a method of using such a highly safe organic sulfur-nitrogen compound having a high ability of preventing the attachment of aquatic organisms, that is antifouling effect, the following method has been proposed.

In this method, for example, a coating material comprising a mixture of the organic sulfur-nitrogen compound and an oily resinous binder such as a drying oil exemplified by linseed oil, tung oil, soy bean oil, dehydrated castor oil, safflower oil and fish oil; a phenol resin; an oily resinous varnish; and an alkyd resin which is a reaction product of a polyhydric alcohol and a dicarboxylic acid is applied to the surface of the equipment and then cured. Although this method shows the desired effect in early stage after immersed into sea water, the effect of preventing the attachment of aquatic organisms disappears in a short period of time because the effective component and the resin component in the coating are leached into sea water or the coating is detached from the coated surface by wear due to its poor bonding strength.

As mentioned above, by using the organic sulfur-nitrogen compound, no method having a high and sufficiently durable effect on preventing the attachment of aquatic organisms is obtained in any of the fishery field, nautical field and civil engineering field.

The above problems are also found in sensors for water analysis and filters used in sea water and fresh water. To solve the problems, it has been attempted to use a sensor having a cover coated with an antifouling coating containing the organotin compound. However, this method was found not suitable for practical use due to environmental pollution, toxicity to human body and marine organisms and adverse effect on the water analysis. Alternatively, when the detector of the sensor is directly coated with the antifouling coating, the detector fails to become direct contact with water, thereby making the water analysis impossible.

SUMMARY OF THE INVENTION

An object of the present invention is to provide a structure which can prevent, over a long period of time, the attachment of aquatic organisms to an underwater equipment used in contact with sea water or fresh water.

Another object of the present invention is to provide a water-permeable cover for a water analysis sensor, which can prevent the attachment of aquatic organisms to the water analysis sensor for a long time, and does not disturb the free flow of water in the vicinity of the sensor, thereby enabling the sensor to provide accurate data of water for a long time.

Still another object of the present invention is to provide a filter for use in sea water and fresh water, which can prevent clogging due to the attachment of aquatic organisms for a long time and maintain an excellent filtering property.

Still another object of the present invention is to provide a cover for a bottom or a screw of a ship, which is made of a water-permeable structure capable of preventing the attachment of aquatic organisms for a long time and attachable to or detachable from the bottom or the screw easily due to its suitable water permeability.

Thus, in a first aspect of the present invention, there is provided a water-permeable structure made of a molded member comprising, as a major component thereof, a thermoplastic resin composition comprising 0.1 to 20% by weight of a compound represented by the following general formula (1):

(1)

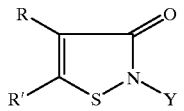

wherein Y represents a hydrogen atom, an alkyl group, an alkenyl group or an aralkyl group, R represents hydrogen atom, a halogen atom or an alkyl group, R' represents hydrogen wherein Y represents hydrogen atom, an alkyl group, an alkenyl group or an aralkyl group, R represents hydrogen atom, a halogen atom or an alkyl group, R' represents hydrogen atom, a halogen atom or an alkyl group and R and R' may be bonded to each other to form a benzene ring, the molded member having through-holes so that the water-permeable structure has a water permeability of 1 $cm^3/cm^2 \cdot sec$ or more under a pressure of 18 cm water.

In a second aspect of the present invention, there is provided a water-permeable structure comprising, as a major component, a fibrous material containing a thermoplastic resin composition comprising the compound represented by general formula (1) shown above, wherein the structure has a water permeability of 1 $cm^3/cm^2 \cdot sec$ or more under a pressure of 18 cm water, and the fibrous material is a fiber of the thermoplastic resin composition; a yarn coated with the thermoplastic resin composition on at least part of a surface thereof; a rope coated with the thermoplastic resin composition on at least part of a surface thereof; or a woven fabric coated with the thermoplastic resin composition on at least part of a surface thereof.

In a third aspect of the present invention, there is provided a structure made of a molded member comprising, as a major component thereof, a thermoplastic resin composition comprising 0.1 to 20% by weight of the compound represented by general formula (1) shown above, wherein an integrated leaching amount of the compound of the formula (1) into an artificial sea water for initial 10 days is 30 $mg/cm^3$ or less at 25° C. and 3 $mg/cm^3$ or more at 15° C. per unit volume of the thermoplastic resin composition when the structure is immersed in the artificial sea water.

In a fourth aspect of the present invention, there is provided a structure comprising, as a major component thereof, a fibrous material containing a thermoplastic resin composition comprising 0.1 to 20% by weight of the compound represented by general formula (1) shown above, wherein an integrated leaching amount of the compound of the formula (1) into an artificial sea water for initial 10 days is 30 $mg/cm^3$ or less at 25° C. and 3 $mg/cm^3$.or more at 15° C. per unit volume of the thermoplastic resin composition when the structure is immersed in the artificial sea water, and the fibrous material being a fiber of the thermoplastic resin composition; a yarn coated with the thermoplastic resin composition on at least part of a surface thereof; a rope coated with the thermoplastic resin composition on at least part of a surface thereof; or a woven fabric coated with the thermoplastic resin composition on at least part of a surface thereof.

The present invention also provides a cover for a sensor, a filter for use in sea water or fresh water, a cover for a bottom of a ship, a cover for a screw of a ship and a cover for a wave-powered buoy, each being made of the structure mentioned above.

DESCRIPTION OF THE PREFERRED EMBODIMENTS

Figure 1:
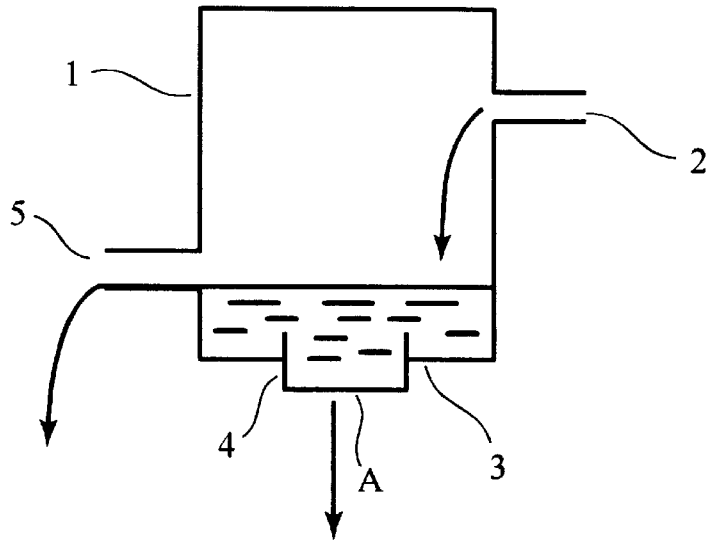
FIG. 1 is a schematic diagram showing an apparatus for measuring a water permeability of a water-permeable structure.

It is critical in the present invention that the antifouling structure is made of a thermoplastic resin composition containing a specific amount of the compound (may be referred to as an antifouling agent) represented by the general formula (1):

(1)

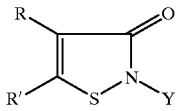

In the formula (1), Y represents hydrogen atom, an alkyl group, an alkenyl group or an aralkyl group. Of the alkyl groups, an alkyl group having 1 to 18 carbon atoms such as methyl group, butyl group, hexyl group, octyl group, nonyl group and dodecyl group is preferable. Of the alkenyl groups, an alkenyl group having 2 to 18 carbon atoms such as 1-propenyl group, allyl group, vinyl group and isopropenyl group is preferable. Of the aralkyl groups, an aralkyl group having 7 to 10 carbon atoms such as benzyl group, phenethyl group and 4-methoxybenzyl group is preferable. R represents hydrogen atom, a halogen atom or an alkyl group. R' represents hydrogen atom, a halogen atom or an alkyl group. Of the halogen atoms for R or R', chlorine, bromine and fluorine are preferable. Of the alkyl groups for R or R', an alkyl group having 1 to 4 carbon atoms such as methyl group, ethyl group, propyl group and butyl group is preferable. R and R' may be bonded to each other to form a benzene ring.

Specific examples of the compound of the formula (1) include 2-methyl-4-isothiazoline-3-one, 2-methyl-5-chloro- 4-isothiazoline-3-one, 1,2-benzoisothiazoline-3-one, 2-n-octylisothiazoline-3-one and 4,5-dichloro-2-n-octylisothiazoline-3-one, etc. In view of obtaining more excellent result in preventing the attachment of aquatic organisms, it is preferable that R and R' both represent halogens and Y represents an alkyl group having 1 to 9 carbon atoms. 4,5-Dichloro-2-n-octylisothiazoline-3-one is particularly preferable.

The compound of the formula (1) may form a complex in combination with a metal salt such as zinc chloride, zinc bromide, zinc iodide, zinc sulfate, zinc acetate, copper chloride, copper bromide, copper nitrate, nickel chloride, calcium chloride, magnesium chloride, iron chloride, manganese chloride, sodium chloride and barium chloride; an ammonium salt such as ammonium chloride; or an amine salt such as amine chlorides.

The content of the compound of the formula (1) in the thermoplastic resin composition is varied depending on the shape and the construction of the molded member. In view of obtaining an excellent effect of preventing the attachment of aquatic organisms, it is important that the content is 0.1% by weight or more based on the total amount of the thermoplastic resin composition. An excessively large content does not provide any further improvement in preventing the attachment of aquatic organisms, rather problems occur in the production process or handling of the molded member. Therefore, the upper limit of the content is preferably 20% by weight. The content is more preferably 3 to 15% by weight.

Examples of the thermoplastic resin to be mixed with the antifouling agent include an aromatic polyester such as polyethylene terephthalate (PET), polybutylene terephthalate (PBT) and polyhexamethylene terephthalate (PHMT); an aliphatic polyester such as polylactic acid, polyethylene succinate, polybutylene succinate, poly-3-hydroxybutylene valerate and polycaprolactone; a polyamide such as nylon 6, nylon 66, nylon 12 and nylon 4; a polyolefin such as polyethylene and polypropylene; polyvinyl chloride; polyvinyl alcohol; an ethylene-vinyl alcohol copolymer; polyacrylonitrile; polyurethane; polyisoprene; polybutadiene; SBR; a styrene-isoprene elastomer; a hydrogenated product of the above polymers; and various elastomers such as a polyester elastomer, a polyether elastomer, a polyolefin elastomer and a polyamide elastomer.

In view of preventing vaporization and thermal decomposition of the antifouling agent during the melt-molding at a high temperature and ensuring uniform kneading of the antifouling agent with the thermoplastic resin, a polyester, particularly PH having a backbone structure comprising a hexamethylene terephthalate unit derived from terephthalic acid and 1,6-hexanediol is preferable. More preferably, such a polyester may contain, as a comonomer unit, a unit derived from isophthalic acid in an amount of 5 to 20% by mol based on the total amount of the dicarboxylic acid component because the incorporation thereof improves workability and melt properties.

In addition to isophthalic acid, examples of the copolymerizable monomer for the polyester include a diol such as ethylene glycol, diethylene glycol, 1,4-butanediol, neopentyl glycol, cyclohexane-1,4-dimethanol, tricyclodecanedimethanol, polyethylene glycol and polytetramethylene glycol; a dicarboxylic acid such as naphthalene-2,6-dicarboxylic acid, phthalic acid, α,β-(4-carboxyphenoxy)ethane, 4,4-dicarboxydiphenyl, 5-sodiumsulfoisophthalic acid, adipic acid and sebacic acid; and an ester of the dicarboxylic acid. The content of the comonomer is not particularly limited. However, in considering the gradual leaching of the compound of the formula (1) into sea water or fresh water, and the handling ability of the polymer depending on its crystallinity, glass transition temperature, melting point, softening point, etc., the comonomer content is preferably 5 to 50% by mol and more preferably 10 to 30% by mol for each of the diol component and the dicarboxylic acid component.

The melting point of the thermoplastic resin is preferably 150° C. or lower. The melt viscosity is preferably 10,000 poise or less when measured under the condition of a temperature of 160° C., a capillary length of 10 mm, a capillary diameter of 1 mm and a shearing rate of 1,000 $sec^{-1}$. The melting point and the melt viscosity are adjusted within the above ranges by copolymerization as described above to decrease the melting point, or by adding a suitable amount of a melting point depressant such as polysiloxane, polybutene, liquid paraffin and a medium molecular weight polymer such as a liquid polyester.

In the present invention, to maintain the effect of preventing the attachment of aquatic organisms for a long time, it is important to control the leaching amount of the compound of the formula (1) from the structure into sea water or fresh water. Specifically, it is important that the integrated leaching amount of the antifouling agent into an artificial sea water (sodium chloride: 3% by weight; magnesium chloride: 0.5% by weight; and distilled water: 96.5% by weight) during the initial 10 days after immersed into the artificial sea water is 30 $mg/cm^3$ or less at 25° C. and 3 $mg/cm^3$ or more at 15° C. per unit volume of the thermoplastic resin composition, preferably 3 to 30 $mg/cm^3$ at 25° C. and 3 to 30 $mg/cm^3$ at 15° C.

To control the leaching amount within the above range, the thermoplastic resin together with the antifouling agent is preferably mixed by a liquid polyolefin such as polybutene and a mineral oil, a liquid polyester (a polyester showing fluidity at −50 to 200° C., for example, an aliphatic polyester synthesized from an aliphatic dicarboxylic acid such as adipic acid and sebacic acid and a glycol such as ethylene glycol and butanediol), a polysiloxane, a polyphenol such as a phenol resin, a phenylphenol resin, a xylenol resin, a butylphenol resin, a resorcinol resin and a cresol resin, or an azine compound. Alternatively, the leaching amount of the antifouling agent is preferably controlled by coating the surface of the water-permeable structure with a mineral oil, paraffin, a polysiloxane, a surfactant or a resin emulsion. In particular, to maintain the ability of controlling the leaching amount for a long time, it is preferred to blend the liquid polyester in combination with the cresol resin, preferably a novolak type, into the thermoplastic resin composition.

The blending amount of the compound for controlling the leaching amount of the antifouling agent is not strictly restricted because the blending amount is determined depending on the kind of the thermoplastic resin, the kind of the antifouling agent and the content of the antifouling agent. Generally, the blending amount is preferably 1 to 10% by weight based on the total amount of the thermoplastic resin composition.

In addition, the thermoplastic resin composition may contain a suitable amount of a modifier such as an ultraviolet light absorbent and a crystallization retarder and an additive such as a coloring pigment.

The process for producing the structure of the present invention will be described bellow. The thermoplastic resin composition containing the compound of the formula (1) is made into a molded member by melt-kneading a mixture of the compound of the formula (1), the thermoplastic resin and the optional compound for controlling the leaching amount in a twin-screw kneading extruder to obtain a homogeneous mixture; and then extruding the homogeneous mixture from a die slit to form a film or sheet, injection-molding the homogeneous mixture to form a three-dimensional molded member with desired shape, or extruding the homogeneous mixture from a spinning nozzle to form a fiber.

Two or more molded members in the form of sheet may be combined to form a three-dimensional structure such as a box or a cylinder. Since the sheet-form molded member is not water-permeable, it is required to make through-holes with desired size in the molded member thereby ensuring a water permeability within the range specified below. The through-holes may be formed during the molding step by using a suitably designed mold.

The thermoplastic resin composition containing the antifouling agent may be formed into a fiber using a known melt spinning apparatus. The cross-sectional shape of the fiber may be any of circle, irregular shape and hollow shape. Further, the thermoplastic resin composition may be formed into a composite fiber with a sheath-core structure or a side-by-side structure by spinning with another thermoplastic resin such as polyester, polyamide, polyolefin, polyvinylchloride, etc. so that the thermoplastic resin composition containing the antifouling agent appears on at least a part of the composite fiber surface, preferably 50% or more of the composite fiber surface.

Figure 2:
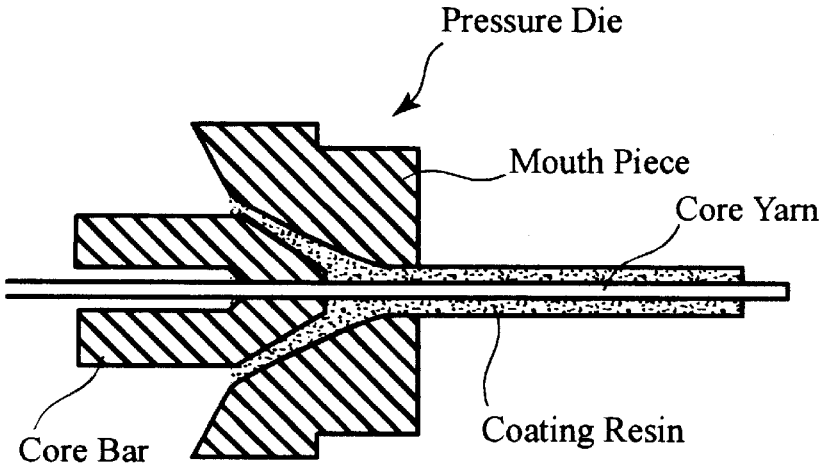
FIG. 2 is a cross-sectional view of a pressure die disposed in an apparatus for producing a resin-coated yarn.
Figure 3:
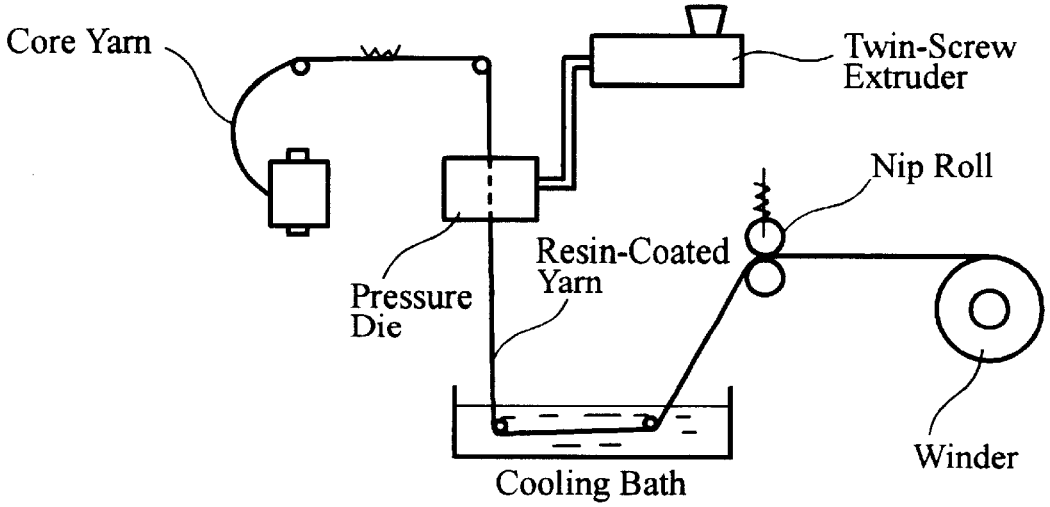
FIG. 3 is a schematic diagram showing a process for producing a resin-coated yarn.

The antifouling structure of the present invention may be constituted by a resin-coated yarn comprising a core yarn coated with the thermoplastic resin composition containing the compound of the formula (1). The resin-coated yarn may be produced by applying a solution of the thermoplastic resin composition in a suitable solvent to the surface of the core yarn. However, in the present invention, the resin-coated yarn is preferably produced by a melt extrusion coating process as shown in FIG. 3 including a pressure die as best shown in FIG. 2. In this process, the materials for the thermoplastic resin composition are uniformly kneaded in a twin-screw extruder to obtain a coating resin which is then supplied to the pressure die. Separately, the core yarn is continuously fed into the pressure die where the surface of the core yarn is coated with the coating resin containing the compound of the formula (1) during passing through a mouse piece as shown in FIG. 2. The coating resin on the core yarn is solidified by passing through a cooling bath, and the resulting resin-coated yarn is taken up on a winder after passing through nip rolls.

The core yarn is preferred to have a melting point, a softening point or a decomposition temperature higher than those of the coating thermoplastic resin by 50° C. or more, and may be suitably selected from a synthetic fiber, a regenerated fiber, a natural fiber, a metal fiber, a glass fiber and a carbon fiber.

The form of the core yarn is not particularly limited, and may be any of a monofilament, a multifilament and a spun yarn. A mixed twist yarn and rope made thereof may be also used, if desired. The core yarn is not needed to be coated with the thermoplastic resin composition throughout its entire surface, i.e., a yarn partially coated with the thermoplastic resin composition may exhibit the effect of the present invention. Further, in place of forming the antifouling structure from the resin-coated yarn, a fabric or rope made of a non-coated fiber, such as a synthetic fiber, a regenerated fiber, a natural fiber, a metal fiber, a glass fiber and a carbon fiber, may be coated with the thermoplastic resin composition on at least a part of the surface thereof.

The structure of the present invention is produced from the molded member, fiber or resin-coated yarn made of the thermoplastic resin composition in a manner described below.

The structure comprising the molded member may be produced by extruding the thermoplastic resin composition containing the antifouling agent into a mold having a cavity defining the geometric shape of the final product and solidifying the thermoplastic resin composition therein. Also, by combining two or more molded members with flat sheet form, the structure with the desired shape may be produced. Further, a molded member in the form of film or sheet may be stacked on at least one surface of a woven fabric made of a synthetic fiber, a regenerated fiber, a natural fiber, a metal fiber, a glass fiber or a carbon fiber, thereby forming a laminate structure. When the water-permeable structure is intended, the molded member is provided with through-holes after molding. Alternatively, the mold is designed so as to form through-holes in the molded member during the molding process.

The process for producing the fibrous structure from a fiber or a resin-coated yarn will be described. A woven fabric, a knitted fabric, a non-woven fabric and a laminated composite thereof are water-permeable by their nature. Therefore, the fibrous structure is preferably used where the water permeability is required. Also, the fibrous structure is preferably used when required to fit a curved shape or a complicated shape, because the fibrous structure is more flexible than a structure made of the molded member.

The woven fabric for constructing the structure of the present invention is obtained by using a loom such as a shuttle loom, a rapier loom, an air jet loom and a gripper loom. The textile weave of the woven fabric is not particularly limited, and may be plain weave, twill weave, satin weave, etc. To control the water permeability under a pressure of 18 cm water within the range specified in the present invention, the weft density, the warp density and yarn denier are suitably selected.

The knitted fabric may include inlay fabric, pile fabric and warp and/or weft inserted Raschel fabric produced by warp knitting on a Raschel machine and a tricot machine. The knitted fabric may be also obtained by weft knitting, stitch bonding or braiding.

Non-woven fabric may be obtained by various known processes such as wet process, dry process forming card webs, spun bond process and melt blow process.

The structure of the present invention includes a composite structure of a thermoplastic resin and a fibrous structure. The composite structure may be obtained, for example, by a coating method where the surface of a fibrous structure made of a woven fabric, a knitted fabric or a non-woven fabric of a natural fiber, a synthetic fiber or an inorganic fiber is coated with a thermoplastic resin solution in a suitable solvent; an extrusion coating method where a thermoplastic resin sheet being extruded is directly laminated on a fibrous structure; or a heat-laminating or dry-laminating method where a thermoplastic resin film or sheet is heat-laminated or dry-laminated on a fibrous structure. In these methods, at least one of the thermoplastic resin and the fibrous structure contains the compound of the formula (1).

Since the above structure has a very small or no water permeability due to the dense thermoplastic resin, through-holes should be formed in the structure so that the structure acquires a desired level of water permeability when used in water-permeable applications.

In addition to the molded member, fiber and resin-coated yarn each having the effect of preventing the attachment of aquatic organisms, an additional material such as a molded member of another resin, an inorganic substance, a synthetic fiber, an inorganic fiber and an organic fiber each having no function of preventing the attachment of aquatic organisms may be also used in combination to constitute the structure of the present invention as far as the effect of the present invention is not adversely affected. Although the relative amounts of the two groups of materials varies depending on the intensity of the ability of preventing the attachment of aquatic organisms of the molded member, fiber or resin-coated yarn, the amount of the material having the ability of preventing the attachment of aquatic organisms is preferably 50% or more of the total weight of the structure.

The additional material may be incorporated into the structure in any manner. In case of a fibrous structure, the additional material is incorporated by combining, mixed spinning, doubling and twisting, mixed weaving or mixed knitting. The resulting fibrous structure may be heat-treated, if desired, to fuse the fibers at their conjunctions thereby enhancing the strength and preventing slippage.

In the present invention, the structure is not particularly limited in its shape and preferably has a water permeability of 1 $cm^3/cm^2 \cdot sec$ or more under a pressure of 18 cm water in a field requiring water permeability such as a filter. Depending on the application, the water permeability may be adjusted to 5 $cm^3/cm^2 \cdot sec$ or more, preferably 10 $cm^3/cm^2 \cdot sec$ or more and more preferably 15 $cm^3/cm^2 \cdot sec$ or more under a pressure of 18 cm water.

The water permeability was determined using an apparatus shown in FIG. 1. As shown in FIG. 1, a cylindrical vessel 1 is equipped with a water inlet 2 at an upper side portion thereof and a water outlet 5 at a lower side portion thereof. An opening 4 is formed at a bottom portion 3 of the cylindrical vessel 1. A water-permeable structure A to be examined is hermetically fixed to the opening 4. Water is continuously supplied from the inlet 2 and continuously overflows through the outlet 5 so that a water column of 18 cm high is always kept on the water-permeable structure A during the measurement. The water permeability in terms of a unit of $cm^3/cm^2 \cdot sec$ was determined from the amount of water passed through the water-permeable structure A in a given period of time.

The inventors have made intensive study to establish a method of monitoring water conditions accurately and stably for a long time using a water analysis sensor. In the study, the sensor was protected from the attachment of aquatic organisms by a cover. As the result, it was found that the restless free flow of the water in the vicinity of the sensor, in addition to the prevention of the attachment of aquatic organisms to the detector of the sensor, is necessary for the accurate analysis of sea water and fresh water. Based on this finding, it was confirmed that the water permeability of the cover for the water analysis sensor was preferably 15 $cm^3/cm^2 \cdot sec$ or more under a pressure of 18 cm water, and more preferably 15 to 200 $cm^3/cm^2 \cdot sec$ in view of maintaining the concentration of the antifouling agent within an effective level for preventing the attachment of aquatic organisms without disturbing the free flow of water in the vicinity of the sensor.

When the water permeability is less than 15 $cm^3/cm^2 \cdot sec$, the actual properties of water in the vicinity of the sensor are changed by the presence of the cover to result in failure of the accurate water analysis. When the water permeability is excessively large, aquatic organisms likely attach to the sensor due to the failure in maintaining the concentration of the antifouling agent in the vicinity of the sensor in the level effective for preventing the attachment of aquatic organisms.

The shape of the cover is not particularly limited as long as the structure is made of the thermoplastic resin composition containing the antifouling agent and has a water permeability specified above. For example, the cover is shaped into a bag so as to cover the entire housing for protecting the sensor, or a parallel arrangement of strips or strings where the strips or strings are connected to each other at end portions.

When a high accuracy as in the water analysis is not required and the prevention of the attachment of aquatic organisms is more important, a water permeability of 5 $cm^3/cm^2 \cdot sec$ or more under a pressure of 18 cm water is sufficient.

In addition to the cover for a sensor of water analysis, the structure of the present invention can be applied to a filter for sea water or fresh water. Such a filter may include a filter to be disposed at a sea water intake for obtaining cooling water in thermoelectric power plants and nuclear power plants and a filter for adsorbing agricultural chemicals in waste water from golf courses, etc. In such an application, the water permeability is preferably 10 $cm^3/cm^2 \cdot sec$ or more and more preferably 15 to 50 $cm^3/cm^2 \cdot sec$ under a pressure of 18 cm water. When the water permeability is less than 10 $cm^3/cm^2 2 \cdot sec$, the resistance to the flow of water becomes excessively great in case of obtaining a large amount of cooling water. When the water permeability is excessively large, the concentration of the antifouling agent cannot be kept in a level effective for preventing the attachment of aquatic organisms. In particular, a structure having a water permeability of 100 to 200 $cm^3/cm^2 \cdot sec$ is preferable for accurate measurement of turbidity in addition to dissolved oxygen in the water analysis.

In an application requiring the water permeability, the structure of the present invention is preferably made of a meshed fabric in view of easiness of controlling the water permeability, easiness of producing the structure and strength and dimensional stability of the structure. In addition to a water permeability as specified above, the meshed fabric is preferred to have an opening of 10 to 30 mesh in terms of mesh size in view of obtaining a good filtering effect.

The fibrous structure of the present invention is also used as a cover for a underwater portion of the ship bottom and the ship bottom structures such as a screw. The fibrous structure prevents aquatic organisms from attaching to the ship bottom and the ship bottom structures as well as attaching to the fibrous structure itself. It is important that the bottom cover for ship of the present invention has a water permeability of 1 $cm^3/cm^2 \cdot sec$ or more, preferably 5 $cm^3/cm^2 \cdot sec$ or more and more preferably 10 $cm^3/cm^2 \cdot sec$ or more under a pressure of 18 cm water. When the water permeability is less than 1 $cm^3/cm^2 \cdot sec$ under a pressure of 18 cm water, the bottom cover cannot be easily moved due to the insufficient water permeability to make the attachment and detachment workability poor.

The structure of the present invention can also be advantageously used as a cover for the underwater portion of a wave-powered buoy. The structure of the present invention may be further used in other various fields, for example, as a fixed net, a fish preserve net for fish cultivation, a rope for fabricating a net, a mooring rope, etc. Also, the structure in the form of dense woven fabric is useful as a cover for preventing aquatic organisms from attaching to an underwater structure.

It has been confirmed that the cover for a sensor of water analysis, the filter, the bottom cover for ship, etc. made of the structure of the present invention effectively prevent the attachment of aquatic organisms over several months, thereby enabling accurate water analysis, undisturbed flow of water and easy attachment and detachment of the bottom cover. In such an application, heretofore, cleaning or replacement of the cover or the filter is required considerably frequently due to immediate attachment of aquatic organisms after several days of the use.

The present invention will be described more specifically with reference to the following examples. However, it should be noted that the present invention is not limited to the examples. The evaluations and the measurements in the examples were conducted in accordance with the following methods.

(1) Attachment of Aquatic Organisms to Sensor

A multi-functional water monitor Model 6000 manufactured by YSI Co., Ltd.; 8.9 cm diameter×49.5 cm long) was covered with a water-permeable structure and submerged into the sea (Shirahama, Wakayama Prefecture, Japan) at a depth of 15 m. The attachment of aquatic organisms to the detector of the sensor was observed repeatedly at regular intervals. The results were evaluated in accordance with the following criteria:

5: No attachment of aquatic organisms.

4: Attachment on about 10% of the entire surface of the detector.

3: Attachment on about 20% of the entire surface of the detector.

2: Attachment on about 50% of the entire surface of the detector.

1: Attachment throughout the entire surface of the detector.

(2) Dissolved Oxygen

The amount of dissolved oxygen was measured continuously using a measuring system connected to the multi-functional water monitor Model 6000.

(3) Attachment of Aquatic Organisms to Bottom Cover for Ship

The bottom of a pleasure boat of 7 m long moored at Seto Inland Sea in Japan was covered with a bottom cover for ship. The attachment of aquatic organisms to the bottom of the boat and the bottom cover was observed. The results were evaluated in accordance with the following criteria:

5: No attachment of aquatic organisms.

4: Attachment on about 10% of the entire surface of the detector.

3: Attachment on about 20% of the entire surface of the detector.

2: Attachment on about 50% of the entire surface of the detector.

1: Attachment throughout the entire surface of the detector.

(4) Leaching amount of antifouling agent

The specific gravity of a thermoplastic resin composition containing an antifouling agent was measured using an electronic specific gravity meter SD-120L (available from rage Boeki Co., Ltd). Then, 0.5 g of the thermoplastic resin composition taken from an antifouling structure was immersed into 300 ml of artificial sea water (a complete solution of 3% sodium chloride and 0.5% magnesium chloride in 96.5% distilled water). Two test mixtures prepared as described above were respectively placed in thermostats at 25° C. and 15° C. while stirring at 65 rpm. The artificial sea water was replaced with a fresh one every 24 hours, and the amount of the antifouling agent in the old artificial sea water was measured by HPLC (high performance liquid chromatography). The replacement and measurement were repeated for 10 days and the leaching amount of the antifouling agent was determined by integrating the leached amounts in the respective artificial sea water.

EXAMPLE 1

A coating resin composition was prepared by mixing 10% by weight of 4,5-dichloro-2-n-octyl-4-isothiazoline-3-one, 6% by weight of a cresol novolak resin (average polymerization degree: 3.6), 4% by weight of an adipic acid-based liquid polyester (ADEKACIZER PN-350; freezing point: −15° C.; viscosity at 25° C.: 10,000 cp; manufactured by Asahi Denka Kogyo Co., Ltd.) and 0.4% by weight of a carbon-based black pigment with polyhexamethylene terephthalate copolymerized with 10% by mol of isophthalic acid (melting point: 135° C.; melt viscosity: 3,500 poise). Using the apparatuses shown in FIGS. 2 and 3, 100 parts by weight of polyethylene terephthalate filament (1,000 d/192 f; single twist of 80 T/m) was coated with 200 parts by weight of the coating resin composition to obtain a resin-coated yarn of 3,000 denier.

Using a rapier loom, the resin-coated yarn was woven to a fabric in plain weave having a warp density of 13.5 warps/inch (3,000 denier), a weft density of 13.5 wefts/inch (3,000 denier×2) and an opening of 6 mesh. The woven fabric was heat-treated in a heat-setting apparatus having three heating zones of 3 m long at 125° C. for 1.5 minutes to fuse the yarns at conjunctions. The resulting fabric had a water-permeability of 150 $cm^3/cm^2 \cdot sec$ under a pressure of 18 cm water.

The integrated leaching amount of the antifouling agent during the initial 10 days of the immersion was 20.4 $mg/cm^3$ at 25° C. and 9.1 $mg/cm^3$ at 15° C.

The above fabric was cut into a sheet of 30 cm×65 cm. The multi-functional water monitor "Model 6,000" was entirely covered with this sheet and submerged into the sea (Shirahama, Wakayama Prefecture in Japan). The amount of dissolved oxygen and pH of the sea water were continuously monitored. The results are shown in Table 1 together with the results of observation on the attachment of aquatic organisms.

No attachment of aquatic organisms to the detector of the sensor was found after three months of the test. Also, no abnormal data attributable to the woven fabric was found on the amount of dissolved oxygen and pH.

EXAMPLE 2

A coating resin composition was prepared by mixing 10% by weight of 4,5-dichloro-2-n-octyl-4-isothiazoline-3-one, 6% by weight of a phenol novolak resin (average polymerization degree: 3.8), 4% by weight of an adipic acid-based liquid polyester (ADEKACIZER PN-350; freezing point: −15° C.; viscosity at 25° C.: 10,000 cp; manufactured by Asahi Denka Kogyo Co., Ltd.) and 0.4% by weight of a carbon-based black pigment with polyhexamethylene terephthalate copolymerized with 10% by mol of isophthalic acid (melting point: 135° C.; melt viscosity: 3,500 poise). Using the apparatuses shown in FIGS. 2 and 3, 100 parts by weight of polyethylene terephthalate filament (500 d/96 f; single twist of 120 T/m) was coated with 200 parts by weight of the coating resin composition to obtain a resin-coated yarn of 1,500 denier.

Using a rapier loom, the resin-coated yarn was woven to a fabric in plain weave having a warp density of 25 warps/ inch (1,500 denier), a weft density of 25 wefts/inch (1,500 denier) and an opening of 27 mesh. The woven fabric was heat-treated in a heat-setting apparatus having three heating zones of 3 m long at 125° C. for 1.5 minutes to fuse the yarns at conjunctions. The resulting fabric had a water-permeability of 27 $cm^3/cm^2 \cdot sec$ under a pressure of 18 cm water.

The integrated leaching amount of the antifouling agent during the initial 10 days of the immersion was 15.9 $mg/cm^3$ at 25° C. and 10.3 $mg/cm^3$ at 15° C.

By using the above fabric, the amount of dissolved oxygen, pH and the attachment of aquatic organisms were measured in the same manner as in Example 1. The results are shown in Table 1.

No attachment of aquatic organisms to the detector of the sensor was found after three months of the test. Also, no abnormal data attributable to the woven fabric was found on the amount of dissolved oxygen and pH.

EXAMPLE 3

A coating resin composition was prepared by mixing 6% by weight of 4,5-dichloro-2-n-octyl-4-isothiazoline-3-one, 6% by weight of polybutene 2000H (average molecular weight: 3,000; manufactured by Idemitsu Petrochemical Co., Ltd.), and 0.4% by weight of a carbon-based black pigment with polyhexamethylene terepthalate copolymerized with 15% by mol of adipic acid (melting point: 132° C.; melt viscosity: 3,000 poise). Using the coating resin composition, a resin-coated yarn of 3,000 denier was obtained in the same manner as in Example 1.

Using a rapier loom, the resin-coated yarn was woven to a fabric in plain weave having a warp density of 32 warps/inch (3,000 denier), a weft density of 18 wefts/inch (3,000 denier) and an opening of 33 mesh. The woven fabric was heat-treated in a heat-setting apparatus having three heating zones of 3 m long at 125° C. for 1.5 minutes to fuse the yarns at conjunctions. The resulting fabric had a water-permeability of 16 $cm^3/cm^2 \cdot sec$ under a pressure of 18 cm water.

The integrated leaching amount of the antifouling agent during the initial 10 days of the immersion was 14.6 $mg/cm^3$ at 25° C. and 10.2 $mg/cm^3$ at 15° C.

By using the above fabric, the amount of dissolved oxygen, pH and the attachment of aquatic organisms were measured in the same manner as in Example 1. The results are shown in Table 1.

No attachment of aquatic organisms to the detector of the sensor was found after two months of the test. Also, no abnormal data attributable to the woven fabric was found on the amount of dissolved oxygen and pH.

EXAMPLE 4

A coating resin composition was prepared by mixing 6% by weight of 4,5-dichloro-2-n-octyl-4-isothiazoline-3-one, 4% by weight of dimethylpolysiloxane (SH200 100000CS; manufactured by Toray and Dow Corning Silicone Inc., Ltd.) and 2% by weight of an azine dye (NUBIAN BLACKS PC-0850; manufactured by Orient Chemical Industries, Ltd.) with polyhexamethylene terephthalate copolymerized with 30% by mol of butanediol (melting point: 126° C.; melt viscosity: 3,600 poise). Using the coating resin composition, a resin-coated yarn of 1,500 denier was obtained in the same manner as in Example 1.

Using a rapier loom, the resin-coated yarn was woven to a fabric in plain weave having a warp density of 25 warps/inch (1,500 denier), a weft density of 25 wefts/inch (1,500 denier) and an opening of 26 mesh. The woven fabric was heat-treated in a heat-setting apparatus having three heating zones of 3 m long at 125° C. for 1.5 minutes to fuse the yarns at conjunctions. The resulting fabric has a water-permeability of 27 $cm^3/cm^2 \cdot sec$ under a pressure of 18 cm water.

The integrated leaching amount of the antifouling agent during the initial 10 days of the immersion was 17.7 $mg/cm^3$ at 25° C. and 7.6 $mg/cm^3$ at 15° C.

By using the above fabric, the amount of dissolved oxygen, pH and the attachment of aquatic organisms were measured in the same manner as in Example 1. The results are shown in Table 1.

No attachment of aquatic organisms to the detector of the sensor was found after two months of the test. Also, no abnormal data attributable to the woven fabric was found on the amount of dissolved oxygen and pH.

EXAMPLE 5

A coating resin composition was prepared by mixing 5% by weight of 4,5-dichloro-2-n-octyl-4-isothiazoline-3-one, 3% by weight of a cresol novolak resin (average polymerization degree: 3.6), and 0.4% by weight of a carbon-based black pigment with a low density polyethylene (melting point: 105° C.; melt viscosity: 3,000 poise). Using the coating resin composition, a resin-coated yarn of 1,500 denier was obtained in the same manner as in Example 1.

Using a rapier loom, the resin-coated yarn was woven to a fabric in plain weave having a warp density of 25 warps/inch (1,500 denier), a weft density of 25 wefts/inch (1,500 denier) and an opening of 26 mesh. The woven fabric was heat-treated in a heat-setting apparatus having three heating zones of 3 m long at 90° C. for 1.5 minutes to fuse the yarns at conjunctions. The resulting fabric had a water-permeability of 27 $cm^3/cm^2 \cdot sec$ under a pressure of 18 cm water.

The integrated leaching amount of the antifouling agent during the initial 10 days of the immersion was 28.4 $mg/cm^3$ at 25° C. and 12.6 $mg/cm^3$ at 15° C.

By using the above fabric, the amount of dissolved oxygen, pH and the attachment of aquatic organisms were measured in the same manner as in Example 1. The results are shown in Table 1.

No attachment of aquatic organisms to the detector of the sensor was found after two months of the test. Also, no abnormal data attributable to the woven fabric was found on the amount of dissolved oxygen and pH.

EXAMPLE 6

A resin composition was prepared by mixing 10% by weight of 4,5-dichloro-2-n-octyl-4-isothiazoline-3-one, 6% by weight of a cresol novolak resin (average polymerization degree: 3.6), 4% by weight of an adipic acid-based liquid polyester (ADEKACIZER PN-350; freezing point: −15° C.; viscosity at 25° C.: 10,000 cp; manufactured by Asahi Denka Kogyo Co., Ltd.) and 0.4% by weight of a carbon-based black pigment with polyhexamethylene terephthalate copolymerized with 10% by mol of isophthalic acid (melting point: 135° C.; melt viscosity: 3,500 poise). After kneading in a 30 mm $\phi$ twin-screw extruder, the resin composition was spun into a fiber through a round hole nozzle. The spun raw fiber was drawn by a roller plate method under the conditions of a hot roller temperature of 40° C., a hot plate temperature of 75° C. and a draw ratio of 3.5 times to obtain a multifilament of 500 d/96 f. After single-twisted with 150 T/m, the multifilament was woven on a rapier loom to a fabric in plain weave having a warp density of 15 warps/inch, a weft density of 15 wefts/inch and a opening of 16 mesh. The water permeability of the resulting woven fabric was 24 $cm^3/cm^2 \cdot sec$ under a pressure of 18 cm water.

The integrated leaching amount of the antifouling agent during the initial 10 days of the immersion was 29.0 $mg/cm^3$ at 25° C. and 13.5 $mg/cm^3$ at 150C.

By using the above fabric, the amount of dissolved oxygen, pH and the attachment of aquatic organisms were measured in the same manner as in Example 1. The results are shown in Table 1.

No attachment of aquatic organisms to the detector of the sensor was found after three months of the test. Also, no abnormal data attributable to the woven fabric was found on the amount of dissolved oxygen and pH.

EXAMPLE 7

A resin composition was prepared by mixing 10% by weight of 4,5-dichloro-2-n-octyl-4-isothiazoline-3-one, 6% by weight of a cresol novolak resin (average polymerization degree: 3.6), 4% by weight of an adipic acid-based liquid polyester (ADEKACIZER PN-350; freezing point: −15° C.; viscosity at 25° C.: 10,000 cp; manufactured by Asahi Denka Kogyo Co., Ltd.) and 0.4% by weight of a carbon-based black pigment with polyhexamethylene terephthalate copolymerized with 10% by mol of isophthalic acid (melting point: 135° C.; melt viscosity: 3,500 poise). After kneading in a twin-screw extruder, the resin composition was extruded into a resin film of 0.20 mm thick through a T-die. The film was heat-laminated to both surface of a substrate fabric in plain weave made of polyethylene terephthalate filament (500 d/96 f; single twist of 150 T/m; 25 warps/inch and 25 wefts/inch) to obtain an antifouling tarpaulin. Then, through-holes with 6 mm diameter, spaced with each other by 1 cm in the longitudinal and transverse directions, were formed in the obtained tarpaulin to obtain a tarpaulin having a water permeability of 48 $cm^3/cm^2 \cdot sec$ under a pressure of 18 cm water. The integrated leaching amount of the antifouling agent during the initial 10 days of the immersion was 20.2 $mg/cm^3$ at 25° C. and 9.3 $mg/cm^3$ at 15° C.

By using the tarpaulin, the amount of dissolved oxygen, pH and the attachment of aquatic organisms were measured in the same manner as in Example 1. The results are shown in Table 1.

No attachment of aquatic organisms to the detector of the sensor was found after three months of the test. Also, no abnormal data attributable to the tarpaulin was found on the amount of dissolved oxygen and pH.

EXAMPLE 8

A resin composition was prepared by mixing 10% by weight of 4,5-dichloro-2-n-octyl-4-isothiazoline-3-one, 6% by weight of a cresol novolak resin (average polymerization degree: 3.6), 4% by weight of an adipic acid-based liquid polyester (ADEKACIZER PN-350; freezing point: −15° C.; viscosity at 25° C.: 10,000 cp; manufactured by Asahi Denka Kogyo Co., Ltd.) and 0.4% by weight of a carbon-based black pigment with polyhexamethylene terephthalate copolymerized with 10% by mol of isophthalic acid (melting point: 135° C.; melt viscosity: 3,500 poise). After kneading in a twin-screw extruder, the resin composition was extruded into a resin film of 0.5 mm thick through a T-die. Then, through-holes with 6 mm diameter, spaced with each other by 1 cm in the longitudinal and transverse directions, were formed in the film having a water permeability of 48 $cm^3/cm^2 \cdot sec$ under a pressure of 18 cm water. The integrated leaching amount of the antifouling agent during the initial 10 days of the immersion was 20.4 $mg/cm^3$ at 25° C. and 9.2 $mg/cm^3$ at 15° C.

By using the film, the amount of dissolved oxygen, pH and the attachment of aquatic organisms were measured in the same manner as in Example 1. The results are shown in Table 1.

No attachment of aquatic organisms to the detector of the sensor was found after three months of the test. Also, no abnormal data attributable to the film was found on the amount of dissolved oxygen and pH.

EXAMPLE 9

The same fabric as in Example 1 was cut into a sheet of 30 cm×65 cm. The multi-functional water monitor "Model 6,000" was entirely covered with this sheet and immersed into a waste water pit of a factory. The amount of dissolved oxygen and pH were continuously measured. Attachment of aquatic organisms was visually observed. The results are shown in Table 1.

No attachment of aquatic organisms to the detector of the sensor was found after three months of the test. Also, no abnormal data attributable to the woven fabric was found on the amount of dissolved oxygen and pH.

COMPARATIVE EXAMPLE 1

A coating resin composition was prepared by mixing 6% by weight of 4,5-dichloro-2-n-octyl-4-isothiazoline-3-one and 0.4% by weight of a carbon-based black pigment with polyhexamethylene terephthalate copolymerized with 10% by mol of isophthalic acid (melting point: 135° C.; melt viscosity: 3,500 poise). Using the apparatuses shown in FIGS. 2 and 3, 100 parts by weight of polyethylene terephthalate filament (500 d/96 f; single twist of 120 T/m) was coated with 200 parts by weight of the coating resin composition to obtain a resin-coated yarn of 1,500 denier.

Using a rapier loom, the resin-coated yarn was woven to a fabric in plain weave of having a warp density of 45 warps/inch (1,500 denier), a weft density of 25 wefts/inch (1,500 denier) and an opening of 46 mesh. The water-permeability of the resulting fabric was 0.8 $cm^3/cm^2 \cdot sec$ under a pressure of 18 cm water.

The integrated leaching amount of the antifouling agent during the initial 10 days of the immersion was 12.3 $mg/cm^3$ at 25° C. and 2.5 $mg/cm^3$ at 15° C.

By using the above fabric, the amount of dissolved oxygen, pH and the attachment of aquatic organisms were measured in the same manner as in Example 1. The results are shown in Table 1.

Although no attachment of aquatic organisms to the detector of the sensor was found after three months of the test, abnormal data were obtained on the amount of dissolved oxygen due to insufficient water permeability.

COMPARATIVE EXAMPLE 2

A coating resin composition was prepared by mixing 0.05% by weight of 4,5-dichloro-2-n-octyl-4-isothiazoline-3-one and 0.4% by weight of a carbon-based black pigment with polyhexamethylene terephthalate copolymerized with 30% by mol of butanediol (melting point: 126° C.; melt viscosity: 3,600 poise). Using the coating resin composition, a resin-coated yarn of 1,500 denier was obtained in the same manner as in Comparative Example 1.

Using a rapier loom, the antifouling resin-coated yarn was woven to a meshed fabric in plain weave having a warp density of 25 warps/inch (1,500 denier), a weft density of 25 wefts/inch (1,500 denier) and an opening of 26 mesh. The meshed fabric was heat-treated in a heat-setting apparatus having three heating zones of 3 m long at 125° C. for 1.5 minutes to fuse the yarns at conjunctions. The resulting meshed fabric had a water-permeability of 27 $cm^3/cm^2 \cdot sec$ under a pressure of 18 cm water.

The integrated leaching amount of the antifouling agent during the initial 10 days of the immersion was 1.2 $mg/cm^3$ at 25° C. and 0.2 $mg/cm^3$ at 15° C.

By using the meshed fabric, the amount of dissolved oxygen, pH and the attachment of aquatic organisms were measured in the same manner as in Example 1. The results are shown in Table 1.

The antifouling effect was poor due to small leaching amount of the antifouling agent. Therefore, aquatic organisms began to attach to the detector of the sensor on seventh day of the test, and abnormal data attributable to the attachment of aquatic organisms to the woven fabric were found on the amount of dissolved oxygen and pH.

COMPARATIVE EXAMPLE 3

A coating resin composition was prepared by mixing 25% by weight of 4,5-dichloro-2-n-octyl-4-isothiazoline-3-one and 0.4% by weight of a carbon-based black pigment with a low density polyethylene (melting point: 105° C.; melt viscosity: 3,000 poise). Using the coating resin composition, a resin-coated yarn of 1,500 denier was obtained in the same manner as in Comparative Example 1.

Using a rapier loom, the antifouling resin-coated yarn was woven to a fabric in plain weave having a warp density of 25 warps/inch (1,500 denier), a weft density of 25 wefts/inch (1,500 denier) and an opening of 26 mesh. The woven fabric was heat-treated in a heat-setting apparatus having three heating zones of 3 m long at 90° C. for 1.5 minutes to fuse the yarns at conjunctions. The resulting fabric had a water-permeability of 27 $cm^3/cm^2 \cdot sec$ under a pressure of 18 cm water.

The integrated leaching amount of the antifouling agent during the initial 10 days of the immersion was 50.5 $mg/cm^3$ at 25° C. and 25.5 $mg/cm^3$ at 15° C.

By using the above fabric, the amount of dissolved oxygen, pH and the attachment of aquatic organisms were measured in the same manner as in Example 1. The results are shown in Table 1.

Although the antifouling effect was high in initial stage due to high leaching amount of the antifouling agent, the effect did not hold long. Therefore, aquatic organisms began to attach to the detector of the sensor after two months of the test, and abnormal data attributable to the attachment of aquatic organisms to the woven fabric were found on the amount of dissolved oxygen and pH.

COMPARATIVE EXAMPLE 4

Using the same meshed fabric as used in Comparative Example 2, the same test as in Example 9 was repeated. The results are shown in Table 1.

Also in waste water of a factory, aquatic organisms attached to the detector of the sensor immediately after the test, and the meshed structure started to be clogged to cause abnormal data on the amount of dissolved oxygen and pH, this making the accurate measurement impossible.

TABLE 1

| | Ex. 1 | Ex. 2 | Ex. 3 | Ex. 4 | Ex. 5 | Ex. 6 | Ex. 7 | Ex. 8 | Ex. 9 | Com. Ex. 1 | Com. Ex. 2 | Com. Ex. 3 | Com. Ex. 4 |
|---|---|---|---|---|---|---|---|---|---|---|---|---|---|
| Water permeabilty ($cm^3/cm^2 \cdot sec$) | 150 | 27 | 16 | 27 | 27 | 24 | 48 | 48 | 150 | 0.8 | 27 | 27 | 27 |
| Leaching Amount ($mg/cm^3$) | | | | | | | | | | | | | |
| 25° C. | 20.4 | 15.9 | 14.6 | 17.7 | 28.4 | 29.0 | 20.2 | 20.4 | 20.4 | 12.3 | 1.2 | 50.5 | 1.2 |
| 15° C. | 9.1 | 10.3 | 10.2 | 7.6 | 12.6 | 13.5 | 9.3 | 9.2 | 9.1 | 2.5 | 0.2 | 25.5 | 0.2 |
| Dissolved oxygen (%) | | | | | | | | | | | | | |
| after 1 day | 5.3 | 5.4 | 5.1 | 5.3 | 5.3 | 5.3 | 5.1 | 5.3 | 8.3 | 4.1 | 4.0 | 5.3 | 8.0 |
| after 3 days | 5.3 | 5.3 | 5.2 | 5.3 | 5.3 | 5.3 | 5.3 | 5.3 | 8.3 | 4.5 | 2.3 | 5.3 | 4.1 |
| after 7 days | 5.1 | 5.1 | 5.0 | 5.2 | 5.1 | 5.2 | 5.2 | 5.0 | 8.2 | 3.5 | 0 | 5.3 | 2.0 |
| after 14 days | 5.2 | 5.2 | 5.1 | 5.2 | 5.2 | 5.2 | 5.2 | 5.2 | 8.2 | 3.2 | 0 | 5.1 | 0 |
| after 1 month | 5.3 | 5.2 | 5.2 | 5.3 | 5.2 | 5.2 | 5.2 | 5.2 | 8.2 | 3.3 | 0 | 5.2 | 0 |
| after 2 months | 5.5 | 5.6 | 5.5 | 5.5 | 5.0 | 5.6 | 5.5 | 5.6 | 8.2 | 3.2 | 0 | 3.2 | 0 |
| after 3 months | 5.5 | 5.4 | 4.0 | 4.2 | 4.2 | 5.5 | 5.6 | 5.5 | 8.0 | 3.2 | 0 | 2.1 | 0 |
| pH | | | | | | | | | | | | | |
| after 7 days | 8.4 | 8.4 | 8.4 | 8.4 | 8.4 | 8.4 | 8.4 | 8.4 | 6.5 | 8.4 | 8.4 | 8.4 | 6.5 |
| after 1 month | 8.4 | 8.4 | 8.4 | 8.4 | 8.4 | 8.4 | 8.4 | 8.4 | 6.5 | 8.4 | 4.0 | 8.4 | 2.0 |
| after 2 months | 8.4 | 8.3 | 8.3 | 8.4 | 8.3 | 8.3 | 8.3 | 8.3 | 6.5 | 8.4 | 2.0 | 8.4 | 2.0 |
| after 3 months | 8.3 | 8.3 | 8.3 | 8.3 | 8.3 | 8.3 | 8.3 | 8.3 | 6.5 | 8.4 | 2.0 | 4.0 | 2.0 |
| Attachment of aquatic organisms | | | | | | | | | | | | | |
| after 7 days | 5 | 5 | 5 | 5 | 5 | 5 | 5 | 5 | 5 | 5 | 2 | 5 | 1 |
| after 1 month | 5 | 5 | 5 | 5 | 5 | 5 | 5 | 5 | 5 | 5 | 1 | 5 | 1 |
| after 2 months | 5 | 5 | 5 | 5 | 5 | 5 | 5 | 5 | 5 | 5 | 1 | 3 | 1 |
| after 3 months | 5 | 5 | 4 | 4 | 4 | 5 | 5 | 5 | 5 | 5 | 1 | 2 | 1 |

The antifouling resin-coated yarn obtained in Example 2 was woven on a rapier loom to a fabric in plain weave having a warp density of 45 warps/inch (1,500 denier), a weft density of 25 wefts/inch (1,500 denier) and an opening of 46 mesh. The resulting fabric had a water-permeability of $cm^3/cm^2 \cdot sec$ under a pressure of 18 cm water. The integrated leaching amount of the antifouling agent during the initial 10 days of the immersion was 20.4 $mg/cm^3$ at 25° C. and 9.1 $mg/cm^3$ at 15° C.

The woven fabric was sewed into a bottom cover for ship. The bottom of a pleasure boat of 7 m long moored at Seto Inland Sea in Japan was covered with the bottom cover. Then, the attachment of aquatic organisms to the bottom of the boat and the bottom cover was observed. The results are shown in Table 2.

The attachment and detachment of the bottom cover were made easily because water between the bottom of the boat and the bottom cover quickly flowed outside through the bottom cover.

After 24 months of the test, no attachment of aquatic organisms to the bottom or the bottom cover were found, and also, no change in the weight of the bottom cover was found.

EXAMPLE 11

The woven fabric in plain weave obtained in Example 2 was sewed into a bottom cover for ship. The attachment of aquatic organisms to the bottom of the boat and the bottom cover was observed in the same manner as in Example 10. The results are shown in Table 2.

The bottom cover was attached to or detached from the bottom of boat very easily. After 24 months of the test, no attachment of aquatic organisms were found on both the bottom and the bottom cover, and also, no change in the weight of the bottom cover was found.

EXAMPLE 12

A meshed woven fabric in plain weave having a water permeability of 50 $cm^3/cm^2 \cdot sec$ under a pressure of 18 cm water and an opening of 16 mesh was obtained in the same manner as in Example 10 except that the warp density was changed to 15 warps/inch (1,500 denier) and the weft density to 15 wefts/inch (1,500 denier). The integrated leaching amount of the antifouling agent during the initial 10 days of the immersion was 20.4 $mg/cm^3$ at 25° C. and 9.1 $mg/cm^3$ at 15° C.

The woven fabric was sewed into a bottom cover for ship. The attachment of aquatic organisms to the bottom of the boat and the bottom cover was observed in the same manner as in Example 10. The results are shown in Table 2.

The bottom cover was attached to or detached from the bottom of boat very easily. After 12 months of the test, no attachment of aquatic organisms were found on both the bottom and the bottom cover, and also, no change in the weight of the bottom cover was found.

COMPARATIVE EXAMPLE 5

A polyester filament (dope-dyed black filament) was woven to a fabric in plain weave (warp density: 25 warps/inch (1,500 d/192 f); weft density: 25 wefts/inch (1,500 d/192 f)) having a water permeability of 10 $cm^3/cm^2 \cdot sec$ under a pressure of 18 cm water, which was then sewed into a bottom cover for ship. The attachment of aquatic organisms to the bottom of the boat and the bottom cover was observed in the same manner as in Example 10. The results are shown in Table 2.

Although the workability of attachment and detachment of the bottom cover was slightly good in the initial stage of the test as compared with Example 10, the attachment and detachment of the bottom cover became impossible after 3 weeks due to a drastic increase in the weight thereof because aquatic organisms began to attach to the bottom cover after about one week of the test. Also, aquatic organisms began to attach to the bottom after 2 months and the attached amount increased after 3 months.

COMPARATIVE EXAMPLE 6

A tape yarn of a high density polyethylene was woven to a fabric in plain weave having a warp density of 8 warps/inch (1,500 denier) and a weft density of 8 wefts/inch (1,500 denier). Then, both surfaces of the woven fabric were extrusion-coated with 100 $\mu$m thick films of a low density polyethylene to obtain a tarpaulin having a water permeability of 0 $cm^3/cm^2 \cdot sec$ under a pressure of 18 cm water. Then, the tarpaulin was sewed into a bottom cover for ship. The attachment of aquatic organisms to the bottom of the boat and the bottom cover was observed in the same manner as in Example 10. The results are shown in Table 2.

The workability of attachment and detachment of the bottom cover was extremely poor, and the attachment of the bottom cover to the bottom of the boat took five times as long as the time taken in Example 10.

After about one week of the test, aquatic organisms began to attach to the cover, and the attachment and detachment of the bottom cover became impossible after one month of the test due to its drastic increase in the weight.

Also, aquatic organisms began to attach to the bottom after 3 months of the test, and the attached amount increased after 6 months.

TABLE 2

| | Ex. 10 | Ex. 11 | Ex. 12 | Com. Ex. 5 | Com. Ex. 6 |
|---|---|---|---|---|---|
| Water Permeability ($cm^3/cm^2 \cdot sec$) | 1 | 27 | 50 | 10 | 0 |
| Leaching Amount ($mg/cm^3$) | | | | | |
| 25° C. | 20.4 | 15.9 | 20.4 | — | — |
| 15° C. | 9.1 | 10.3 | 9.1 | — | — |
| Time required in attachment of bottom cover (min) | about 20 | about 18 | about 16 | about 24 | about 100 |
| Attachment of aquatic organisms to bottom | | | | | |
| after 1 month | 5 | 5 | 5 | 5 | 5 |
| after 2 months | 5 | 5 | 5 | 4 | 5 |
| after 3 months | 5 | 5 | 5 | 2 | 3 |
| after 6 months | 5 | 5 | 5 | 1 | 1 |
| after 12 months | 5 | 5 | 5 | 1 | 1 |
| after 24 months | 5 | 5 | 3 | 1 | 1 |
| Attachment of aquatic organisms to bottom cover | | | | | |
| after 1 month | 5 | 5 | 5 | 1 | |
| after 2 months | 5 | 5 | 5 | 1 | 1 |
| after 3 months | 5 | 5 | 5 | 1 | 1 |
| after 6 months | 5 | 5 | 5 | 1 | 1 |
| after 12 months | 5 | 5 | 5 | 1 | 1 |
| after 24 months | 5 | 5 | 4 | 1 | 1 |

What is claimed is:

1. A structure made of a molded member comprising, as a major component thereof, a thermoplastic resin composition comprising 0.1 to 20% by weight of a compound represented by the following general formula (1):

(1)

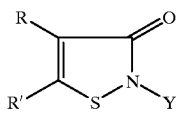

wherein Y represents hydrogen atom, an alkyl group, an alkenyl group or an aralkyl group, R represents hydrogen atom, a halogen atom or an alkyl group, R' represents hydrogen atom, a halogen atom or an alkyl group and R and R' may be bonded to each other to form a benzene ring; and wherein a leaching amount of the compound of formula (1) into an artificial sea water is 30 mg/cm$^3$ or less at 25° C. and 3 mg/cm$^3$ or more at 15° C. per a unit volume of the thermoplastic resin composition when integrated during initial 10 days after immersing the structure into the artificial sea water.

2. The structure according to claim 1, wherein the thermoplastic resin is a polyester having a backbone chain comprising a hexamethylene terephthalate unit derived from terephthalic acid and 1,6-hexanediol.

3. The structure according to claim 1, wherein the thermoplastic resin composition further comprises at least one compound selected from the group consisting of a liquid polyolefin, a liquid polyester, a polysiloxane, a phenol resin, a phenylphenol resin, a xylenol resin, a butylphenol resin, a resorcinol resin, a cresol resin and an azine compound.

4. The structure according to claim 3, wherein said at least one compound comprises the liquid polyester and the cresol resin.

5. The structure according to claim 1, wherein the molded member has through-holes so that the structure has a water permeability of 1 cm$^3$/cm$^2$·sec or more under a pressure of 18 cm water.

6. The structure according to claim 5, wherein the structure is a cover for a sensor for water analysis having a water permeability of 15 cm$^3$/cm$^2$·sec or more under a pressure of 18 cm water.

7. The structure according to claim 1, wherein the molded member is laminated on at least one surface of a woven fabric made of a synthetic fiber, a regenerated fiber, a natural fiber, a metal fiber, a glass fiber or a carbon fiber.

8. The structure according to claim 1, wherein the structure is a cover for a wave-powered buoy.

9. A water-permeable structure made of a molded member comprising, as a major component thereof, a thermoplastic resin comprising 0.1 to 20% by weight of a compound represented by the following general formula (1):

(1)

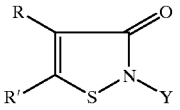

wherein Y represents a hydrogen atom, an alkyl group, an alkenyl group or an aralkyl group, R represents hydrogen atom, a halogen atom or an alkyl group, R' represents hydrogen atom, a halogen atom or an alkyl group and R and R' may be bonded to each other to form a benzene ring; and wherein the molded member comprises through-holes so that the water-permeable structure has a water permeability of 1 cm$^3$/cm$^2$·sec or more under a pressure of 18 cm water.

10. A structure comprising, as a major component, a fibrous material containing a thermoplastic resin composition comprising 0.1 to 20% by weight of a compound represented by the following general formula (1):

(1)

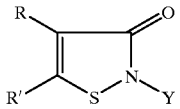

wherein Y represents hydrogen atom, an alkyl group, an alkenyl group or an aralkyl group, R represents hydrogen atom, a halogen atom or an alkyl group, R' represents hydrogen atom, a halogen atom or an alkyl group and R and R' may be bonded to each other to form a benzene ring;

wherein a leaching amount of the compound of formula (1) into an artificial sea water is 30 mg/cm$^3$ or less at 25° C. and 3 mg/cm$^3$ or more at 15° C. per a unit volume of the thermoplastic resin composition when integrated during initial 10 days after immersing the structure into the artificial sea water.

11. The structure according to claim 10, wherein the thermoplastic resin is a polyester having a backbone chain comprising a hexamethylene terephthalate unit derived from terephthalic acid and 1,6-hexanediol.

12. The structure according to claim 10, wherein the thermoplastic resin composition further comprises at least one compound selected from the group consisting of a liquid polyolefin, a liquid polyester, a polysiloxane, a phenol resin, a phenylphenol resin, a xylenol resin, a butylphenol resin, a resorcinol resin, a cresol resin and an azine compound.

13. The structure according to claim 10, wherein said at least one compound comprises the liquid polyester and the cresol resin.

14. The structure according to claim 10, wherein the structure is a meshed fabric.

15. The structure according to claim 10, wherein the structure has a water permeability of 1 cm$^3$/cm$^2$·sec or more under a pressure of 18 cm water.

16. The structure according to claim 10, wherein the structure is a cover for a sensor for water analysis having a water permeability of 15 cm$^3$/cm$^2$·sec or more under a pressure of 18 cm water.

17. The structure according to claim 10, wherein the structure is a filter for sea water or plain water having a water permeability of 10 cm$^3$/cm$^2$sec or more under a pressure of 18 cm water.

18. The structure according to claim 10, wherein the structure is a bottom cover for ship.

19. The structure according to claim 10, wherein the structure is a screw cover for ship.

20. The structure according to claim 10, wherein the structure is a cover for a wave-powered buoy.

21. The structure according to claim 10, wherein said fibrous material comprises a fiber of said thermoplastic resin composition.

22. The structure according to claim 10, wherein said fibrous material comprises a yarn coated with said thermoplastic resin composition on at least part of a surface thereof.

23. The structure according to claim 10, wherein said fibrous material comprises a rope coated with said thermoplastic resin composition on at least part of a surface thereof.

24. The structure according to claim 10, wherein said fibrous material comprises a woven fabric coated with the thermoplastic resin composition on at least part of a surface thereof.

25. A water-permeable structure comprising, as a major component, a fibrous material containing a thermoplastic resin composition comprising 0.1 to 20% by weight of a compound represented by the following general formula (1):

(1)

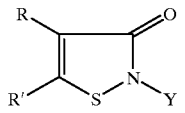

wherein Y represents hydrogen atom, an alkyl group, an alkenyl group or an aralkyl group, R represents hydrogen atom, a halogen atom or an alkyl group, R' represents hydrogen atom, a halogen atom or an alkyl group and R and R' may be bonded to each other to form a benzene ring, a water permeability of the water-permeable structure being 1 $cc/cm^2 \cdot sec$ or more under a pressure of 18 cm water, and the fibrous material being a fiber of the thermoplastic resin composition; a yarn coated with the thermoplastic resin composition on at least part of a surface thereof; a rope coated with the thermoplastic resin composition on at least part of a surface thereof; or a woven fabric coated with the thermoplastic resin composition on at least part of a surface thereof.

26. The structure according to claim 25, wherein said fibrous material comprises a fiber of said thermoplastic resin composition.

27. The structure according to claim 25, wherein said fibrous material comprises a yarn coated with said thermoplastic resin composition on at least part of a surface thereof.

28. The structure according to claim 25, wherein said fibrous material comprises a rope coated with said thermoplastic resin composition on at least part of a surface thereof.

29. The structure according to claim 25, wherein said fibrous material comprises a woven fabric coated with said thermoplastic resin composition on at least part of a surface thereof.

* * * * *